US010400455B2

(12) United States Patent
Izumi et al.

(10) Patent No.: US 10,400,455 B2
(45) Date of Patent: Sep. 3, 2019

(54) METAL ROOFING MEMBER, PRODUCTION METHOD THEREOF, ROOFING STRUCTURE AND ROOFING METHOD

(71) Applicant: NIPPON STEEL NISSHIN CO., LTD., Tokyo (JP)

(72) Inventors: Keiji Izumi, Ichikawa (JP); Yuugo Oota, Ichikawa (JP); Tomoyuki Nagatsu, Ichikawa (JP); Norimasa Miura, Sakai (JP); Katsunari Norita, Sakai (JP); Kenichi Okubo, Ichikawa (JP)

(73) Assignee: NIPPON STEEL NISSHIN CO., LTD., Tokyo (JP)

( * ) Notice: Subject to any disclaimer, the term of this patent is extended or adjusted under 35 U.S.C. 154(b) by 0 days.

(21) Appl. No.: 15/562,064

(22) PCT Filed: Jul. 8, 2015

(86) PCT No.: PCT/JP2015/069637

§ 371 (c)(1),
(2) Date: Sep. 27, 2017

(87) PCT Pub. No.: WO2016/157555

PCT Pub. Date: Oct. 6, 2016

(65) Prior Publication Data

US 2018/0066432 A1 Mar. 8, 2018

(30) Foreign Application Priority Data

Mar. 27, 2015 (JP) ..... 2015-066839

(51) Int. Cl.
*E04D 1/18* (2006.01)
*E04D 1/28* (2006.01)
(Continued)

(52) U.S. Cl.
CPC ..... *E04D 1/18* (2013.01); *E04D 1/28* (2013.01); *E04D 3/30* (2013.01); *E04D 3/352* (2013.01)

(58) Field of Classification Search
CPC ..... E04D 3/30; E04D 3/352; E04D 1/18
See application file for complete search history.

(56) References Cited

U.S. PATENT DOCUMENTS 2,438,099 A * 3/1948 Whitehouse ..... E04D 1/28 52/11
3,479,784 A * 11/1969 Massagli ..... E04C 2/292 160/235

(Continued)

FOREIGN PATENT DOCUMENTS

JP 50-006522 U1 1/1975
JP 01-158165 A 6/1989

(Continued)

OTHER PUBLICATIONS

International Search Report cited in PCT/JP2015/069637, dated Aug. 25, 2015, 2 pages.

*Primary Examiner* — Paola Agudelo
(74) *Attorney, Agent, or Firm* — Rothwell Figg Ernst & Manbeck P.C.

(57) ABSTRACT

A metal roofing member 1 is disposed side by side with another metal roofing member on a roof base. The metal roofing member 1 has a box-shaped front substrate 10 made of a metal sheet, a rear substrate 11 disposed on the rear side of the front substrate 10, so as to cover an opening of the front substrate 10, and a core material 12 made from a foam resin and filled in between the front substrate 10 and the rear substrate 11. The front substrate 10 results from forming the metal sheet into a box shape. The front substrate 10 has a side wall portion that is continuous in the circumferential direction and is formed by performing drawing or bulging processing on the metal sheet. The front substrate 10 has a height of 4 mm to 8 mm.

9 Claims, 3 Drawing Sheets

(51) Int. Cl.
*E04D 3/30* (2006.01)
*E04D 3/35* (2006.01)

(56) References Cited

U.S. PATENT DOCUMENTS 3,535,844 A * 10/1970 Glaros ..... E04C 2/296 52/309.9
3,540,116 A * 11/1970 Bohnsack ..... E04C 2/28 156/563
4,130,975 A * 12/1978 Kelley ..... E04C 2/08 52/546
4,186,539 A * 2/1980 Harmon ..... E04B 1/6129 52/580
4,445,302 A * 5/1984 Dean ..... E04D 3/36 52/278
4,445,305 A * 5/1984 Orie, Sr. ..... E04D 13/165 52/309.9
4,574,555 A * 3/1986 Cline ..... B29C 37/0085 52/783.1
5,285,609 A * 2/1994 Goad ..... E04C 2/292 52/588.1
5,394,672 A * 3/1995 Seem ..... B32B 15/04 52/794.1
5,709,053 A * 1/1998 Kuroda ..... B29B 17/0026 181/284
6,314,701 B1 * 11/2001 Meyerson ..... E04C 2/292 52/309.9
7,107,731 B2 * 9/2006 Record ..... E04C 2/288 52/284
7,607,271 B2 * 10/2009 Griffin ..... E04C 2/296 52/478
8,590,251 B2 * 11/2013 Bandera ..... E04F 13/0876 52/545

FOREIGN PATENT DOCUMENTS

JP 10-238073 A 9/1998
JP 10-306548 A 11/1998
JP 2002-309752 A 10/2002
JP 2003-074163 A 3/2003
JP 2013-096057 A 5/2013

* cited by examiner

-Prior Art-

METAL ROOFING MEMBER, PRODUCTION METHOD THEREOF, ROOFING STRUCTURE AND ROOFING METHOD

CROSS REFERENCE TO RELATED APPLICATION

This application is a 35 U.S.C. 371 National Phase Entry Application from PCT/JP2015/069637, filed Jul. 8, 2015, which claims the benefit of Japanese Patent Application No. 2015-066839 filed on Mar. 27, 2015, the disclosure of which are incorporated herein in their entirety by reference.

TECHNICAL FIELD

The present invention relates to a metal roofing member that is disposed side by side with another metal roofing member on a roof base.

BACKGROUND ART

Examples of types of such metal roofing members used conventionally include the structures disclosed in PTL 1 to 3 among others. In a conventional metal roofing member a metal sheet having a shape such as the one illustrated in FIG. 5 is formed, by bending, to a box-shaped front substrate. For instance concrete, a synthetic resin foam or a synthetic resin sheet is filled in or sandwiched in a gap of the front substrate.

CITATION LIST

Patent Literature

[PTL 1] Japanese Patent Application Publication No. 2003-74147

[PTL 2] Japanese Patent Application Publication No. S52-97228

[PTL 3] Japanese Patent Application Publication No. H02-190553

SUMMARY OF INVENTION

Technical Problem

Such a conventional metal roofing member has a constant thickness in order to secure functionality as a roofing member. However, problems such as those described below arise due to the fact that the metal roofing member is merely shaped as a box by folding. Recent years have witnessed rapid growth in installation of solar cell modules on roofs. Such solar cell modules are generally disposed side by side on a roof base, by way of fastening fittings or the like, but roofing members are nevertheless required to be thinner, from the viewpoint of structural constraints and design, and also for reasons of, for instance, reduction in the size of members for module fastening. When a conventional metal roofing member obtained by bending is thin, however, the wind pressure resistance performance of the member decreases, which is problematic.

An object of the present invention, arrived at in order to solve the above problem, is to provide a metal roofing member and a production method thereof, as well as a roofing structure and a roofing method, that allow enhancing wind pressure resistance performance.

Solution to Problem

The metal roofing member according to the present invention is a metal roofing member disposed side by side with another metal roofing member on a roof base, the metal roofing member including: a box-shaped front substrate made of a metal sheet; a rear substrate disposed on the rear side of the front substrate, so as to cover an opening of the front substrate; and a core material made from a foam resin and filled in between the front substrate and the rear substrate, wherein the front substrate has a side wall portion that is continuous in the circumferential direction and is formed by performing drawing or bulging processing on the metal sheet, with the height of the front substrate being set to 4 mm to 8 mm.

The method for producing a metal roofing member according to the present invention is a method for producing a metal roofing member provided with a box-shaped front substrate made of a metal sheet; a rear substrate disposed on the rear side of the front substrate, so as to cover an opening of the front substrate; and a core material made from a foam resin and filled in between the front substrate and the rear substrate, the method including: performing drawing or bulging processing on the metal sheet so as to form the front substrate having a side wall portion continuous in the circumferential direction, and having a height set to 4 mm to 8 mm.

The roofing structure of the present invention is provided with a plurality of metal roofing members, each having: a box-shaped front substrate made of a metal sheet; a rear substrate disposed on the rear side of the front substrate, so as to cover an opening of the front substrate; and a core material made from a foam resin and filled in between the front substrate and the rear substrate, the front substrate having a side wall portion that is continuous in the circumferential direction and is formed by performing drawing or bulging processing on the metal sheet, with the height of the front substrate being set to 4 mm to 8 mm, wherein the plurality of metal roofing members are disposed side by side on a roof base while side wall portions are caused to butt each other.

The roofing method according to the present invention includes: using a plurality of metal roofing members, each having: a box-shaped front substrate made of a metal sheet; a rear substrate disposed on the rear side of the front substrate, so as to cover an opening of the front substrate; and a core material made from a foam resin and filled in between the front substrate and the rear substrate, the front substrate having a side wall portion that is continuous in the circumferential direction and is formed by performing drawing or bulging processing on the metal sheet, with the height of the front substrate being set to 4 mm to 8 mm; and arranging the plurality of metal roofing members side by side on a roof base, while causing side wall portions to butt each other.

Advantageous Effects of Invention

The metal roofing member, production method thereof, roofing structure and roofing method of the present invention allow enhancing wind pressure resistance performance since the front substrate has the side wall portion that is continuous in the circumferential direction and is formed by performing drawing or bulging processing on a metal sheet, and since the height of the front substrate is set to 4 mm to 8 mm.

DESCRIPTION OF EMBODIMENTS

Embodiments for carrying out the present invention will be explained next with reference to accompanying drawings.

Embodiment 1

Figure 1:
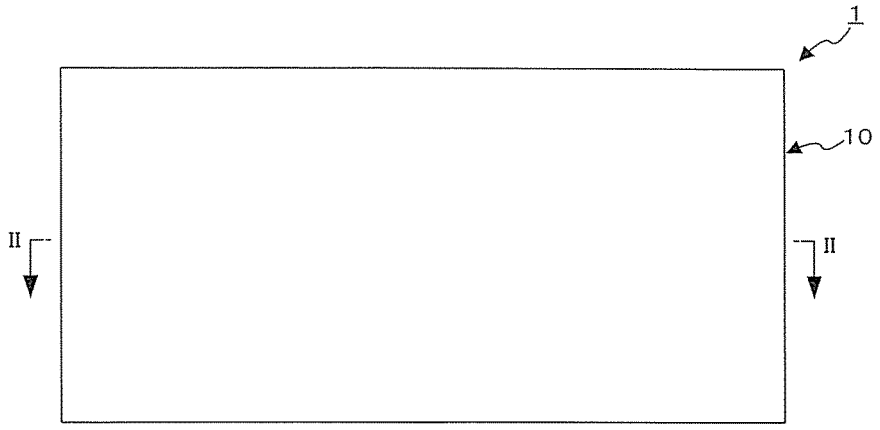
FIG. 1 is a plan-view diagram illustrating a metal roofing member according to Embodiment 1 of the present invention.
Figure 2:
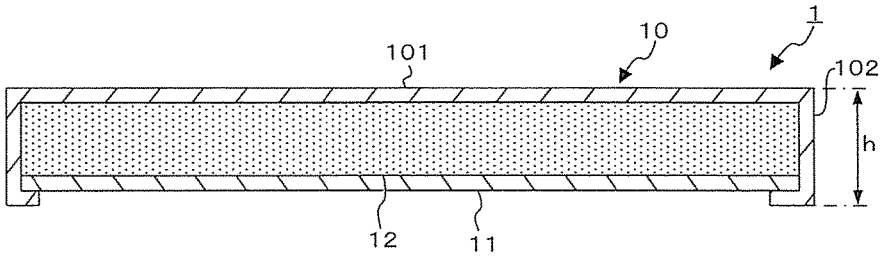
FIG. 2 is a cross-sectional diagram along line II-II in FIG. 1.

FIG. 1 is a plan-view diagram illustrating a metal roofing member 1 according to Embodiment 1 of the present invention, and FIG. 2 is a cross-sectional diagram along line II-II in FIG. 1.

The metal roofing member 1 illustrated in FIG. 1 and FIG. 2 is disposed side by side with another metal roofing member, on a roof base of a building such as a house. As depicted in particular in FIG. 2, the metal roofing member 1 has a front substrate 10, a rear substrate 11 and a core material 12.

The front substrate 10, made of a metal sheet, is a member that appears on the outside of a roof when the metal roofing member 1 is disposed on a roof base.

As the metal sheet, which is a material of the front substrate 10, a hot-dip Zinc-based plated steel sheet, a hot-dip Al plated steel sheet, a hot-dip Zinc-based plated stainless steel sheet, a hot-dip Al plated stainless steel sheet, a stainless steel sheet, a coated hot-dip Zinc-based plated steel sheet, a coated hot-dip Al plated steel sheet, a coated hot-dip Zinc-based plated stainless steel sheet, a coated hot-dip Al plated stainless steel sheet, a coated stainless steel sheet, a coated Al sheet or a coated Ti sheet can be used.

Preferably, the thickness of the metal sheet is 0.27 mm to 0.5 mm. A greater thickness of the metal sheet entails a stronger but also heavier roofing member. By setting the thickness of the metal sheet to be 0.27 mm or greater, it becomes possible to sufficiently secure the strength required from the roofing member, and sufficiently achieving wind pressure resistance and tread-down properties. By setting the thickness of the metal sheet to be 0.5 mm or smaller, it becomes possible to prevent the weight of the metal roofing member 1 from becoming excessive, and to keep down the total weight of the roof when equipment such as a solar cell module, a solar water heater, an air conditioner outdoor unit or snow melting equipment is provided on the roof.

The front substrate 10 is formed to a box shape having a top plate 101 and a side wall portion 102. The front substrate 10 is formed by performing drawing or bulging processing on a metal sheet. As a result the side wall portion 102 constitutes a wall surface that is continuous in the circumferential direction of the front substrate 10. By virtue of the fact that the side wall portion 102 is set to constitute a continuous wall surface in the circumferential direction, the stress acting on the front substrate 10 can be received over the entire side wall portion 102, and it becomes possible to enhance the wind pressure resistance performance of the metal roofing member 1. The term wind pressure resistance performance denotes performance to the effect that the metal roofing member 1 resists strong wind without buckling.

In particular, the hardness of the side wall portion 102 is increased by work hardening during formation of the front substrate 10 by drawing or bulging processing, in a case where a steel sheet (hot-dip Zinc-based plated steel sheet, a hot-dip Al plated steel sheet, a hot-dip Zinc-based plated stainless steel sheet, a hot-dip Al plated stainless steel sheet, a stainless steel sheet, a Al sheet, a Ti sheet, a coated hot-dip Zinc-based plated steel sheet, a coated hot-dip Al plated steel sheet, a coated hot-dip Zinc-based plated stainless steel sheet, a coated hot-dip Al plated stainless steel sheet or a coated stainless steel sheet) is used as the metal sheet of the front substrate 10. Specifically, the Vickers hardness of the side wall portion 102 is increased to about 1.4 to 1.6 times the hardness before working. The wind pressure resistance performance of the metal roofing member 1 is significantly enhanced by virtue of the fact that the side wall portion 102 is set to constitute a wall surface that is continuous in the circumferential direction and that the hardness of the side wall portion 102 is increased by work hardening.

Figure 5:
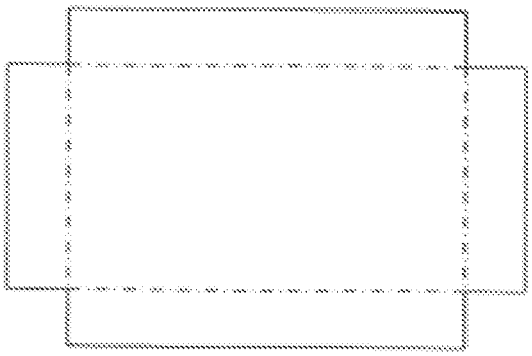
FIG. 5 is an explanatory diagram illustrating the configuration of a conventional metal roofing member.

Breaks appear in the side wall portions when a metal sheet is bent to be formed as a box shape, as in the conventional configuration illustrated in FIG. 5. Side wall portions separated from each other by the breaks receive individually the stress acting on the front substrate. As a result, the metal roofing member buckles even with a weaker wind than is the case in the configuration of the present invention, in which the side wall portion 102 is a wall surface that is continuous in the circumferential direction. Also, work hardening does not occur throughout the wall portions just by bending of the metal sheet.

The rear substrate 11 is a member disposed on the rear side of the front substrate 10, so as to cover an opening of the front substrate 10. A lightweight material such as aluminum foil, aluminum metallized paper, aluminum hydroxide paper, calcium carbonate paper, a resin film, or glass fiber paper can be used as the rear substrate 11. Increases in the weight of the metal roofing member 1 can be avoided by using such lightweight materials as the rear substrate 11.

The core material 12 is made from a foam resin and is filled in between the front substrate 10 and the rear substrate 11. By filling of the space between the front substrate 10 and the rear substrate 11 by a foam resin, it becomes possible to firmly bring the core material 12 into close contact with the interior of the front substrate 10, to a greater degree than in an implementation where a backing material such as a resin sheet is affixed to the rear side of the front substrate 10, and it becomes possible to improve the performance required from the roofing member, for instance in terms of rain sound properties, heat insulation properties and tread-down resistance.

In a configuration where breaks are formed between side wall portions, as in a conventional configuration, such breaks must be sealed in order to avoid leakage of foam resin through the breaks. Such an operation is not necessary, by contrast, when the side wall portion 102 is a wall surface continuous in the circumferential direction, as in the configuration of the present embodiment.

The material of the core material 12 is not particularly limited, and for instance a urethane, phenol or nurate resin can be used. In roofing members, however, it is essential to use an incombustibility-certified material. The test for incombustible material certification is a heat release test performed according to the cone calorimeter test method of ISO 5660-1. The thickness of the front substrate 100 can be reduced, and inorganic foamed particles can be incorporated into the foam resin constituting the core material 12, in a case where the foam resin is for instance urethane, which has a large calorific value.

Height h of the front substrate 10 filled with the core material 12 is set to 4 mm to 8 mm. The strength of the front substrate 10 can be increased and the wind pressure resistance improved by setting the height h of the front substrate 100 to be 4 mm or greater. Further, the organic mass of the core material 12 can be prevented from becoming excessive, and incombustible material certification can be obtained yet more reliably, by setting the height h of the front substrate 10 to be 8 mm or smaller.

Figure 3:
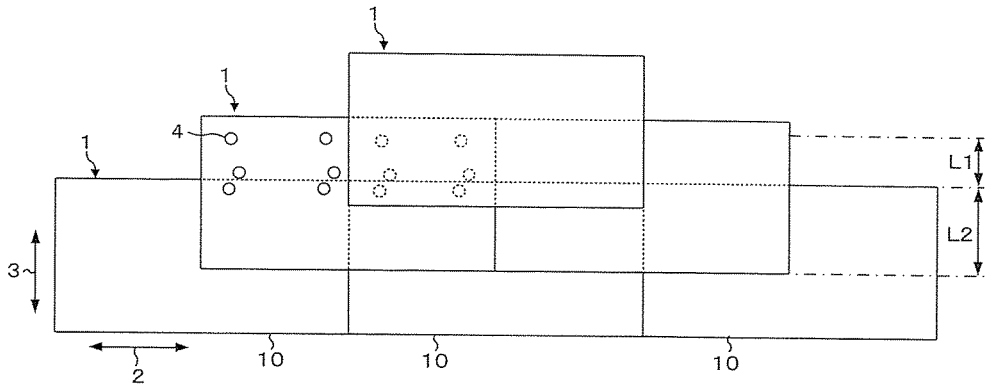
FIG. 3 is an explanatory diagram illustrating a roofing structure and a roofing method that utilize the metal roofing member illustrated in FIG. 1 and FIG. 2.
Figure 4:
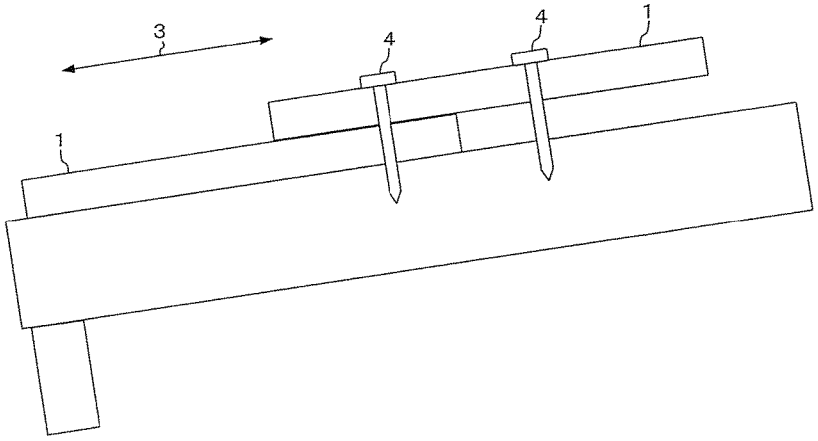
FIG. 4 is an explanatory diagram illustrating the relationship between two metal roofing members of FIG. 3, disposed offset from each other in an eave-ridge direction.

Next, FIG. 3 is an explanatory diagram illustrating a roofing structure and a roofing method that utilize the metal roofing member 1 illustrated in FIG. 1 and FIG. 2. FIG. 4 is an explanatory diagram illustrating the relationship between two metal roofing members 1 that are disposed offset from each other in the eave-ridge direction 3 of FIG. 3.

As illustrated in FIG. 3, a metal roofing member 1 is disposed on a roof base while one side end of the front substrate 10 butts the side end of the front substrate 10 of another metal roofing member 1. In further detail, a plurality of metal roofing members 1 are disposed side by side on the roof base, while the side ends of respective front substrates 10 butt each other in a direction 2 parallel to an eave. The metal roofing members 1 are fixed to the roof base via stopping members 4 such as nails. In order to avoid an overly complex figure, the stopping members 4 are depicted in FIG. 3 only for one metal roofing member 1, while the stopping members 4 of other metal roofing members 1 are omitted in the figure.

Butting of side ends of front substrates 10 against each other denotes herein a configuration where the side ends of adjacent front substrates 10 are in contact with each other, or a configuration where side ends of front substrates 10 of adjacent metal roofing members 1 are brought close to each other. The metal roofing members 1 disposed side by side have an identical configuration. However, other metal roofing members can be used at positions where conditions are different, such as at roof edges.

The plurality of metal roofing members 1 are disposed on the roof base while eave-side end sections of ridge-side metal roofing members 1 overlap ridge-side end sections of eave-side metal roofing members 1, in the eave-ridge direction 3. At least some of the stopping members 4 are driven so as to run through both the eave-side metal roofing members 1 and ridge-side metal roofing members 1. By driving of the stopping members 4 so as to run through both the eave-side metal roofing members 1 and ridge-side metal roofing members 1, it becomes possible to arrange ridge-side metal roofing members 1 substantially parallelly to the eave-side metal roofing members 1, as illustrated in FIG. 5, and to reduce lifting of the eave-side end sections of the ridge-side metal roofing members 1. Watertightness of the roof can be enhanced by reducing the lifting of the eave-side end sections of the ridge-side metal roofing members 1.

As illustrated in FIG. 3, a length L2 over which the metal roofing members 1 overlap each other in the eave-ridge direction 3 is greater than a length L1 over which ridge-side metal roofing members 1 do not overlap eave-side metal roofing members 1 (L2>L1). As a result, the stopping members 4 can be driven so as to run through both the eave-side metal roofing members 1 and ridge-side metal roofing members 1 over a wider region.

Examples are illustrated next. The inventors experimentally produced test members of the metal roofing member 1 under the conditions given below.

Herein a 0.20 mm to 0.8 mm coated hot-dip Zn-55% Al plated steel sheet, a coated hot-dip Zn-6% Al-3% Mg plated steel sheet or a coated hot-dip Al plated steel sheet was used as the material of the front substrate 10.

Further, 0.2 mm glass fiber paper, 0.2 mm Al metallized paper, a 0.2 mm PE resin film or a 0.1 mm Al foil was used as the rear substrate 11.

A foam resin of two-liquid mixture type was used as the core material 12. The mixing ratio of a polyol component and isocyanate, phenol or nurate component was set to 1:1, in ratio by weight.

Concrete and synthetic resin sheets were also tested, for comparison.

The front substrate 10 was worked to a predetermined thickness and shape of the roofing member. Working involved drawing or bulging processing with use of a press machine. The clearance of a forming die, forming speed, surface lubricity and material temperature during work were adjusted so that the Vickers hardness of the side wall portion after work was 1.4 to 1.6 times that before work. For comparison, a box-shaped roofing member was also produced by 90°-bending using a bender.

The rear substrate 11 was disposed on the rear side of the worked front substrate 10, so as to cover the opening of the front substrate 10, and a foam resin was injected into the gap between the front substrate 10 and the rear substrate 11, using a commercially available high-pressure injection machine. Resin foaming was accomplished by holding for 2 minutes in a mold, the temperature of which was adjusted to 70° C. by hot water circulation; thereafter, the roofing member was removed from the mold, and was allowed to stand for 5 minutes under conditions of room temperature of 20° C., to complete foaming of the resin.

Once resin foaming was complete, a flange portion was cut out, and the resulting member was bent using a bender. The dimensions of the final metal roofing member 1 were set to 414 mm×910 mm. The thickness of the final roofing member was set to 4 mm to 8 mm.

For comparison, also a specimen of a metal roofing member (conventional configuration) was produced through inward 90°-bending of the four sides of a 0.3 mm coated hot-dip Zn-55% Al alloy plated steel sheet as the front substrate, using a bender, to yield a box shape, followed by injection of a foam resin in accordance with the above-described method.

Herein 0.2 mm glass fiber paper was used as the rear substrate. The thickness dimension of the roofing member was set to 6 mm, while other conditions were set to be identical to the conditions above.

For comparison, there were tested also a metal roofing member having no foam resin injected thereinto, and a roofing member obtained by bonding a commercially available 0.3 mm thermally-insulating polyethylene sheet, by way of an adhesive, to a worked front substrate.

The inventors used the above test members to evaluate (1) the wind pressure resistance of the roofing member, (2) the weight of the roofing member, (3) the tread-down properties of the roofing member, and (4) heat insulation properties. The results are given in the table below.

TABLE 1

| | | Evaluation results | | | | | | | | | |
|---|---|---|---|---|---|---|---|---|---|---|---|
| | | Details of test members | | | | | | | | | |
| | | Front substrate | | | | | | Wind | Roofing | | Heat |
| No. | | Height (mm) | Type (note 1) | Thickness (mm) | Working method | Core material | Rear substrate type (note 2) | pressure resistance | member weight | Tread-down properties | insulation properties |
| 1 | Example | 4 | A | 0.27 | Drawing | Foamed urethane | a | ⊗ | ○ | ○ | ○ |
| 2 | | 4 | B | 0.3 | Drawing | Foamed urethane | b | ⊗ | ○ | ○ | ○ |
| 3 | | 5 | C | 0.3 | Drawing | Foamed urethane | a | ⊗ | ○ | ○ | ○ |
| 4 | | 6 | A | 0.3 | Bulging | Foamed nurate | b | ⊗ | ○ | ○ | ○ |
| 5 | | 5 | A | 0.5 | Bulging | Foamed nurate | a | ⊗ | ○ | ○ | ○ |
| 6 | | 6 | A | 0.5 | Bulging | Foamed nurate | c | ⊗ | ○ | ○ | ○ |
| 7 | | 8 | A | 0.5 | Bulging | Foamed nurate | d | ⊗ | ○ | ○ | ○ |
| 8 | | 8 | D | 0.5 | Bulging | Foamed nurate | d | ○ | ○ | ○ | ○ |
| 9 | Comparative | 6 | A | 0.27 | Drawing | None | a | Δ | ○ | ○ | X |
| 10 | example | 6 | A | 0.27 | Bending | Concrete | a | X | X | ○ | Δ |
| 11 | | 6 | A | 0.27 | Bending | Resin sheet | a | X | ○ | ○ | Δ |
| 12 | | 6 | A | 0.27 | Bending | Foamed nurate | a | X | ○ | ○ | ○ |
| 13 | | 3 | B | 0.25 | Drawing | Foamed nurate | a | Δ | ○ | ○ | X |
| 14 | | 9 | C | 0.6 | Drawing | Foamed nurate | b | ⊗ | X | ○ | ○ |

(note 1) A: coated hot-dip Zn—55% Al plated steel sheet; B: coated hot-dip Al plated steel sheet; C: coated hot-dip Zn—6% Al—3% Mg plated steel sheet; D: aluminum
(note 2) a: glass fiber paper; b: Al metallized paper; c: PE resin film; d: Al foil (1) Evaluation Criteria Certification of Wind Pressure Resistance of the Roofing Member A wind pressure resistance test was carried out in accordance with Japanese Industrial Standard A 1515. Specifically, a dynamic wind pressure tester was used to observe the occurrence or absence of breakage in a test specimen when pressed in a pressing process. In the evaluation of wind pressure resistance, based on breaking pressure at the time of induced breakage, a breaking pressure being negative pressure of 6,000 N/m$^2$ or greater was rated as excellent (⊗), a negative pressure from 5,000 N/m$^2$ to less than 6,000 N/m$^2$ was rated as good (○), a negative pressure in the range of 2,250 N/m$^2$ to less than 5,000 N/m$^2$ was rated as fair (Δ) and a negative pressure of less than 2,250 N/m$^2$ was rated as poor (x).

(2) Evaluation Criteria of Roofing Member Weight

The unit weight of the roofing members was measured and evaluated in accordance with the criteria below. The evaluation envisaged installation of a standard 130 N/m$^2$ solar cell module on the roof, using the following evaluation criteria based on the weight of the roof as a whole including the roofing member.

○: unit weight of roofing member being smaller than 250 N/m$^2$ x: unit weight of roofing member being 250 N/m$^2$ or greater (3) Tread-down Properties of the Roofing Member The full body weight of a person weighing from 65 kg to 75 kg, standing on one leg, was applied to the central portion of the roofing member, after which the deformation of the roofing member in an unloaded state was evaluated visually. Severe deformation was rated as poor (x), light deformation was rated as fair (Δ) and absence of deformation was rated as good (○).

(4) Evaluation Method and Evaluation Criteria of Heat Insulation Properties

Thermocouples were attached to the rear surface of roofing boards and the front substrate surface of a simulated roof in which rainwater pooling had been evaluated. Twelve lamps (100/110 V, 150 W) were disposed evenly distributed at positions located 180 mm from the surface of this simulated roof. The temperature of the rear of the roofing boards after 1 hour or irradiation at a lamp output of 60% was measured by the thermocouples, to evaluate heat insulation properties.

The heat insulation properties were rated according to the following criteria.

○: temperature of the rear of the roofing board lower than 50° C.

Δ: temperature of the rear of the roofing board from 50° C. to 55° C.

x: temperature of the rear of the roofing board of 55° C. or higher

In Table 1, the evaluation of wind pressure resistance was poor (x) for Nos. 10 to 12. This is deemed to arise from the fact that the front substrate in Nos. 10 to 12 was formed by folding, similarly to conventional configurations. In other test members, by contrast, the evaluation of wind pressure resistance yielded ratings of fair (Δ), good (○) or excellent (⊗), since the front substrate had been formed by drawing or bulging processing. This revealed the superiority of forming the front substrate by drawing or bulging processing.

Wind pressure resistance in Nos. 9 and 13 was evaluated as fair (Δ). This is deemed to derive from the fact that the core material 12 is omitted in No. 9 and that the height h of the front substrate in No. 13 is smaller than 4 mm. This confirmed the superiority of providing the core material 12 and of setting the height h of the front substrate to be 4 mm or greater, in a configuration where the front substrate is formed by drawing or bulging processing. Although Table 1 does not set out test results and so forth in particular, the organic mass of the core material 12 can be prevented from becoming excessive, and incombustible material certification can be obtained yet more reliably, by setting the height of the front substrate 10 to be 8 mm or smaller.

It is deemed that wind pressure resistance in No. 13 is low due to the fact that the thickness of the front substrate is smaller than 0.27 mm. The thickness of the front substrate in No. 14 exceeded 0.5 mm, and the evaluation of the roofing member weight was poor (x). These results confirmed the superiority of a range of 0.27 mm to 0.5 mm of the thickness of the metal sheet that makes up the front substrate 10.

Wind pressure resistance in No. 8 was evaluated as good (○). This confirmed that good wind pressure resistance performance can be improved by forming the front substrate by drawing or bulging processing, also for metals such as Al, other than steel sheets.

Wind pressure resistance in Nos. 1 to 7 was evaluated as excellent (⊗). This confirmed that drawing or bulging processing on the steel sheet results in higher hardness of the side wall portion 102, thanks to work hardening, and in significantly enhanced wind pressure resistance performance of the metal roofing member 1.

Although Table 1 does not set out test results and so forth in particular, the weight of the metal roofing member 1 can be prevented from being excessive by using a lightweight material, such as glass fiber paper, Al metallized paper, a PE resin film or Al foil in the rear substrate. The problem of large roofing member weight arises when a metal sheet such as that of the front substrate is used in the rear substrate.

Such metal roofing member 1 and production method thereof, as well as such roofing structure and roofing method, allow increasing wind pressure resistance performance since the front substrate 10 has the side wall portion 102 that is continuous in the circumferential direction and is formed by performing drawing or bulging processing on a metal sheet, and since the height of the front substrate 10 is set to 4 mm to 8 mm. As a result, it becomes possible to provide a roofing member that is thinner than in conventional configurations, while maintaining wind pressure resistance performance.

The metal sheet being the material of the front substrate 10 is made of a hot-dip Zinc-based plated steel sheet, a hot-dip Al plated steel sheet, a hot-dip Zinc-based plated stainless steel sheet, a hot-dip Al plated stainless steel sheet, a stainless steel sheet, a coated hot-dip Zinc-based plated steel sheet, a coated hot-dip Al plated steel sheet, a coated hot-dip Zinc-based plated stainless steel sheet, a coated hot-dip Al plated stainless steel sheet or coated stainless steel sheet; hence, the hardness of the side wall portion 102 can be increased, and wind pressure resistance performance further enhanced, by performing drawing or bulging processing.

Further, the thickness of the metal sheet that makes up the front substrate 10 is 0.27 mm to 0.5 mm, and accordingly it becomes possible to suppress increases in weight while securing wind pressure resistance performance.

Moreover, the weight of the metal roofing member 1 can be prevented from being excessively large, since the rear substrate 11 is made of aluminum foil, aluminum metallized paper, aluminum hydroxide paper, calcium carbonate paper, a resin film or glass fiber paper.

The invention claimed is:

1. A metal roofing member disposed side by side with another metal roofing member on a roof base, comprising:

a box-shaped front substrate made of a metal sheet;

a rear substrate disposed on a rear side of the front substrate, so as to cover an opening of the front substrate; and a core material made from a foam resin and filled in between the front substrate and the rear substrate, wherein the front substrate has a side wall portion that is continuous in the circumferential direction and is formed by performing drawing or bulging processing on the metal sheet, with the height of the front substrate being set to 4 mm to 8 mm;

wherein the metal sheet is comprised of a steel sheet, and a Vickers hardness of the side wall portion is greater than a Vickers hardness of the metal sheet.

2. The metal roofing member according to claim 1, wherein the metal sheet, which is a material of the front substrate is made of a hot-dip Zinc-based plated steel sheet, a hot-dip Al plated steel sheet, a hot-dip Zinc-based plated stainless steel sheet, a hot-dip Al plated stainless steel sheet, a stainless steel sheet, a coated hot-dip Zinc-based plated steel sheet, a coated hot-dip Al plated steel sheet, a coated hot-dip Zinc-based plated stainless steel sheet, a coated hot-dip Al plated stainless steel sheet or a coated stainless steel sheet.

3. The metal roofing member according to claim 1, wherein the thickness of the metal sheet that makes up the front substrate is 0.27 mm to 0.5 mm.

4. The metal roofing member according to claim 1, wherein the rear substrate is made of aluminum foil, aluminum metallized paper, aluminum hydroxide paper, calcium carbonate paper, a resin film or glass fiber paper.

5. The metal roofing member according to claim 1, wherein the Vickers hardness of the side wall portion is 1.4 to 1.6 times the Vickers hardness of the metal sheet.

6. A roofing structure comprising a plurality of metal roofing members, each having:

a box-shaped front substrate made of a metal sheet;

a rear substrate disposed on a rear side of the front substrate, so as to cover an opening of the front substrate; and a core material made from a foam resin and filled in between the front substrate and the rear substrate, the front substrate having a side wall portion that is continuous in the circumferential direction and is formed by performing drawing or bulging processing on the metal sheet, with the height of the front substrate being set to 4 mm to 8 mm, wherein the plurality of metal roofing members are disposed side by side on a roof base while the side wall portion of each metal roofing member is caused to butt each other;

wherein the metal sheet is comprised of a steel sheet, and a Vickers hardness of the side wall portion is greater than a Vickers hardness of the metal sheet.

7. The roofing structure according to claim 6, wherein the metal sheet is comprised of a steel sheet, and a Vickers hardness of the side wall portion is greater than a Vickers hardness of the metal sheet.

8. The roofing structure according to claim 7, wherein the Vickers hardness of the side wall portion is 1.4 to 1.6 times the Vickers hardness of the metal sheet.

9. The roofing structure according to claim 6, wherein the plurality of metal roofing members are disposed side by side in a direction parallel to an eave of a roof, and eave-side end sections of metal roofing members disposed by the ridge-side of the roof overlap ridge-side end sections of metal roofing members disposed by the eave-side of the roof in an eave-ridge direction of the roof.

* * * * *